US008544121B1

(12) United States Patent
Majocka et al.

(10) Patent No.: US 8,544,121 B1
(45) **Date of Patent: *Oct. 1, 2013**

(54) CARRIER FOR WALL MOUNTED TOILETS

(75) Inventors: Christopher A. Majocka, Erie, PA (US); Benjamin Eichler, Erie, PA (US); Doug Wroblewski, Erie, PA (US)

(73) Assignee: Zurn Industries, LLC, Erie, PA (US)

( * ) Notice: Subject to any disclaimer, the term of this patent is extended or adjusted under 35 U.S.C. 154(b) by 31 days.

This patent is subject to a terminal disclaimer.

(21) Appl. No.: 13/401,432

(22) Filed: Feb. 21, 2012

Related U.S. Application Data

(63) Continuation of application No. 11/880,442, filed on Jul. 20, 2007, now Pat. No. 8,141,177.

(60) Provisional application No. 60/834,084, filed on Jul. 28, 2006.

(51) Int. Cl.
*E03D 11/00* (2006.01)
*E03D 11/14* (2006.01)

(52) U.S. Cl.
USPC ..... 4/252.3; 4/252.2

(58) Field of Classification Search
USPC ..... 4/252.1–252.6
See application file for complete search history.

(56) References Cited

U.S. PATENT DOCUMENTS 3,098,242 A 7/1963 Armbruster et al.
3,944,175 A 3/1976 Kearney
4,058,859 A 11/1977 Arrowood
4,091,473 A 5/1978 Matthews et al.
4,482,161 A 11/1984 Izzi, Sr.
4,979,239 A 12/1990 Klein et al.
5,205,056 A 4/1993 Okajima et al.
6,889,392 B1 5/2005 Karnopp et al.
6,979,027 B2 12/2005 Hetzler et al.
7,146,655 B2 12/2006 Karnopp et al.
2004/0133969 A1 7/2004 Akin

OTHER PUBLICATIONS

Zurn Industries, Inc. "Zurn Z-1203-H carrier", specification sheet, Aug. 9, 1994, 1 p. published in USA.
Specification Sheet for Z1203-N4-M, "Adjustable Horizontal Siphon Jet No-Hub", Zurn Industries, LLC, Feb. 24, 2011.
Specification Sheet for Z1210-45, "Finishing Frame for Siphon Jet System", Zurn Industries, LLC, Nov. 18, 2010.

*Primary Examiner* — Gregory Huson
*Assistant Examiner* — Janie Christiansen
(74) *Attorney, Agent, or Firm* — The Webb Law Firm

(57) ABSTRACT

A carrier or support system for a wall mounted toilet for adequately supporting the weight of a user. A first support assembly has a faceplate, spaced-apart pedestals, two washer plates, a fitting member, a coupling, a first fastener for allowing vertical movement between the pedestals and the faceplate, a second fastener for allowing vertical movement between the fitting member and the faceplate, and a first threaded stud arrangement for mounting the toilet to the wall. A second support assembly has a support member, a second threaded stud arrangement, and an anchor foot for supporting the fitting member on the floor. A third support assembly has a frame and a third threaded stud arrangement mounted to the frame for supporting the frame on the floor. The second and/or third support assemblies may be used with the first support assembly for providing adequate support for bariatric or obese users.

20 Claims, 15 Drawing Sheets

CARRIER FOR WALL MOUNTED TOILETS

CROSS REFERENCE TO RELATED APPLICATIONS

This application is a continuation of U.S. patent application Ser. No. 11/880,442, filed on Jul. 20, 2007, which claims the benefit of U.S. Provisional Patent Application No. 60/834,084, filed on Jul. 28, 2006, both of which are hereby incorporated by reference in their entireties.

BACKGROUND OF THE INVENTION

1. Field of the Invention

The invention relates to wall mounted toilets, and in particular, to a carrier or a support system for adequately supporting a toilet and the weight of the user.

2. Description of Related Art

Wall mounted toilets or water closets are known in the art. In order to mount a wall mounted toilet to the wall, and in order to support the weight of a user on the toilet, it is common to provide a suitable support system, most of which is disposed behind the wall for supporting both the toilet and related plumbing. An example of such a carrier is a Zurn Z-1203H carrier provided by the Zurn Industries, Inc., Erie, Pa.

It is also known that bariatric toilets need to withstand the weight of the bariatric or obese user. This becomes particularly important when the bariatric toilet is mounted to the wall.

U.S. Pat. Nos. 6,889,392 and 7,146,655 disclose a bariatric toilet seat support apparatus designed to be placed under a toilet seat such that when an individual uses the toilet seat, the weight of the individual is transferred from the toilet seat to the support apparatus thereby avoiding distribution of weight to the toilet itself. These support apparatuses of the prior art generally are a complicated construction located outside the wall and under the toilet seat.

There is a need, therefore, in the art to provide an improved support system for wall mounted toilets that substantially provide support to the user regardless of whether the user is considered as being of normal weight or as being obese or of bariatric weight.

SUMMARY OF THE INVENTION

The invention is directed to a support system, also known as wall carriers, for wall mounted toilets that are able to support a greater amount of weight compared to prior art support systems for wall mounted toilets.

The invention provides a support system for mounting a toilet to a wall of a structure and having a first support assembly. The first support assembly includes a faceplate having a first and a second side, and a hole extending through the faceplate; at least two spaced-apart pedestals abutting against the first side of the faceplate; at least two washer plates, each abutting against one of the pedestals; a fitting member having an inlet and abutting against the first side of the faceplate between the pedestals; a coupling positioned within the hole of the faceplate for connecting a discharge port of the toilet to the inlet member of the fitting member; a first fastener connecting the washer plates, the pedestals and the faceplate together and wherein the pedestals are configured to allow vertical movement between the pedestals and the faceplate; a second fastener connecting the faceplate and the fitting member together and wherein the faceplate is configured to allow vertical movement between the fitting member and the faceplate; and a first threaded stud arrangement associated with the second side of the faceplate for positioning the first support assembly relative to the wall of the structure for mounting the toilet.

The invention further provides a support system that in addition to the first support assembly disclosed in the preceding paragraph, also includes a second support assembly. This second support assembly includes the fitting member having a support member with a slot, a second threaded stud arrangement in engagement with the slot of the support member and an anchor foot in engagement with the second threaded stud arrangement for supporting the fitting member on the floor of the structure for mounting the toilet. The anchor foot can be adjusted vertically relative to the first support assembly and the floor of the structure.

The invention further provides a support system that in addition to the first support assembly and the second support assembly disclosed in the above two preceding paragraphs, optionally includes a third support assembly. This third support assembly includes a frame having an opening for receiving the coupling of the first support assembly. The frame is mounted to and supported by the first threaded stud arrangement of the first support assembly. A third threaded stud arrangement is mounted to the frame on opposite sides of the coupling for supporting the frame on the floor surface, and is configured to vertically adjust the frame relative to the first floor assembly and to the floor of the structure.

In the first support assembly, an annular recessed slot is provided in the faceplate and an O-ring is received in the annular recessed slot of the faceplate. A gasket is in alignment with the hole of the faceplate and the inlet of the fitting member of the first support assembly and has threaded holes through which the second fastening arrangement extends for mounting the gasket between the faceplate and the fitting member.

A further embodiment of the invention provides a toilet attached to the wall of a structure including a first support assembly, and optionally, the second support assembly and the third support assembly as described hereinabove. Still further embodiments of the invention include methods for attaching a toilet to a wall of a structure by installing the first support assembly, and optionally, the second support assembly and the third support assembly as described hereinabove, and the methods include adjusting the second and third support systems so they are supported on the floor of the structure.

It is therefore an object of the invention to provide a toilet attached to a wall of a structure having a support system that adequately supports the weight of a user.

It is also an object of the invention to provide an improved support system for a wall mounted toilet having a first support assembly, and whereby a second support assembly and a third support assembly can be added to the first support assembly in order to provide additional support according to the weight of the user.

These and other objects and advantages of the invention will be made apparent from the following description taken together with the drawings.

DETAILED DESCRIPTION OF THE INVENTION

Figure 1:
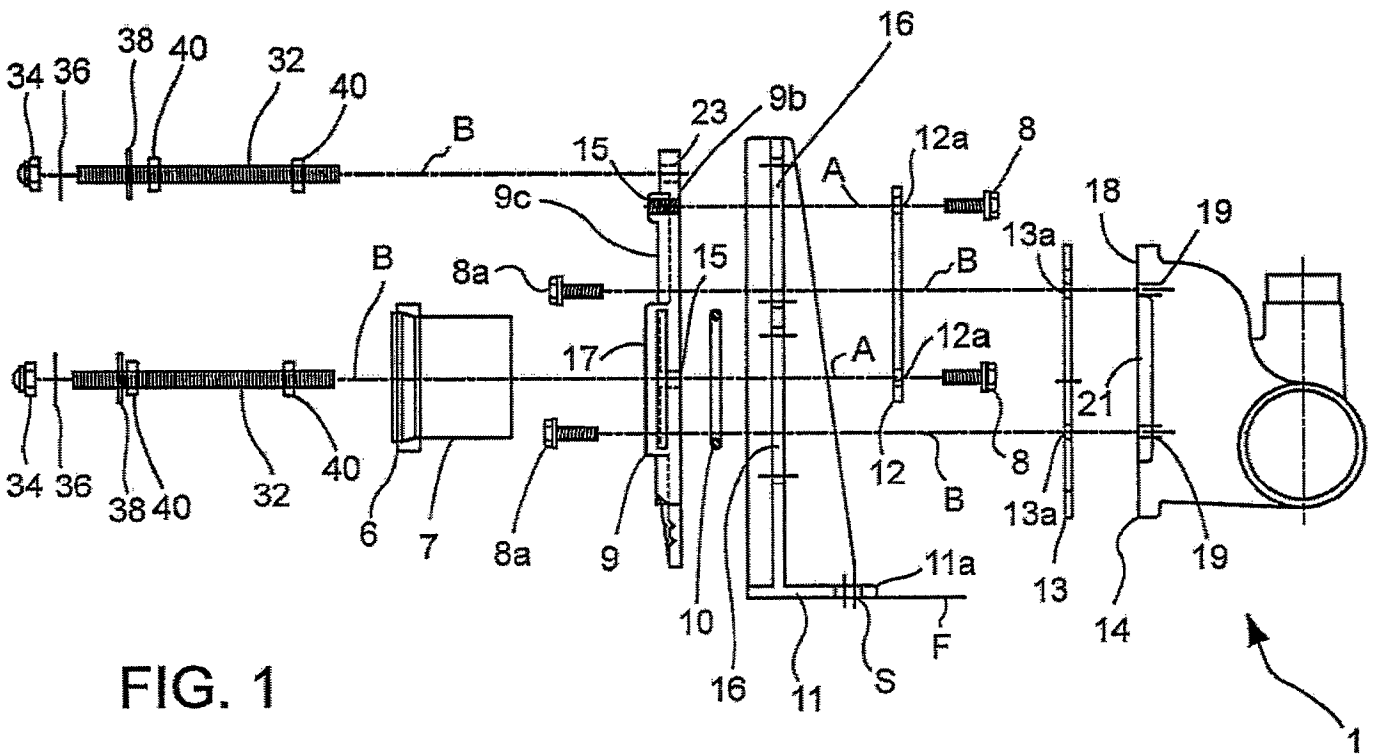
FIG. 1 is an exploded side elevation view of a carrier or a support system illustrating a first support assembly in accordance with the teachings of the present invention.

The present invention will be described with reference to the accompanying drawings where like reference numbers correspond to like elements. It is to be appreciated that some of the reference numbers do not appear in some of the drawings for clarity reasons.

FIGS. 1-16 illustrate a support system of the invention for mounting a toilet to the wall. The support system of FIGS. 1-16, also referred to as a narrow wall carrier, generally is located behind an inner wall IW (FIG. 4*a*) and between the inner wall IW and outer wall OW (FIG. 4*a*) of a structure where the toilet T is located, for example, a residence or a commercial building.

FIGS. 1-9 particularly refer to a first support assembly 1 of the support system of the invention. Referring particularly to FIGS. 1-4*a*, the support system of the invention includes a first support assembly 1. This first support assembly 1 has a cylindrical plastic coupling 7, a faceplate 9, two spaced-apart feet or pedestals 11, two mounting plates or washers 12, a gasket 13, shown best in FIG. 1, and a pipe fitting member 14. As shown in FIG. 4*a*, the first support assembly 1 is used to mount toilet T to the inner wall IW via a mounting plate MP and is supported on the floor F of the structure. In accordance with conventional practice, coupling 7 generally is connected to a toilet discharge port DP extending through the inner wall IW of the structure for mounting of toilet T against the inner wall IW. Fitting member 14 generally is connected to a piping system (not shown) for supplying water to and carrying water and waste away from the toilet T and first support assembly 1. Also, according to conventional practice, the two spaced-apart pedestals 11 are supported on the floor surface F and can be bolted thereto through suitable means extending in slot S provided in each pedestal 11.

Figure 3:
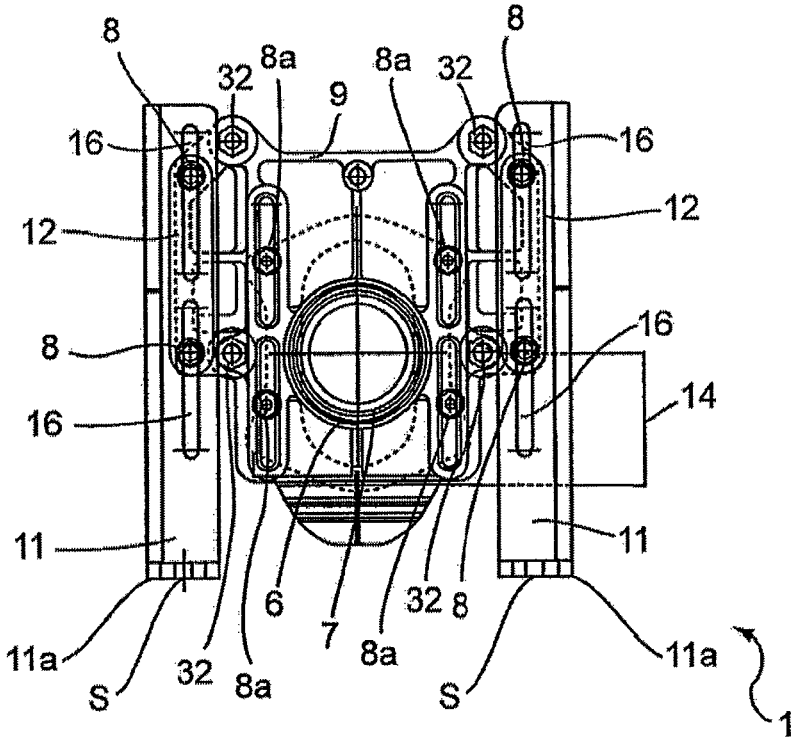
FIG. 3 is a front elevational view of the carrier of FIG. 2.
Figure 4:
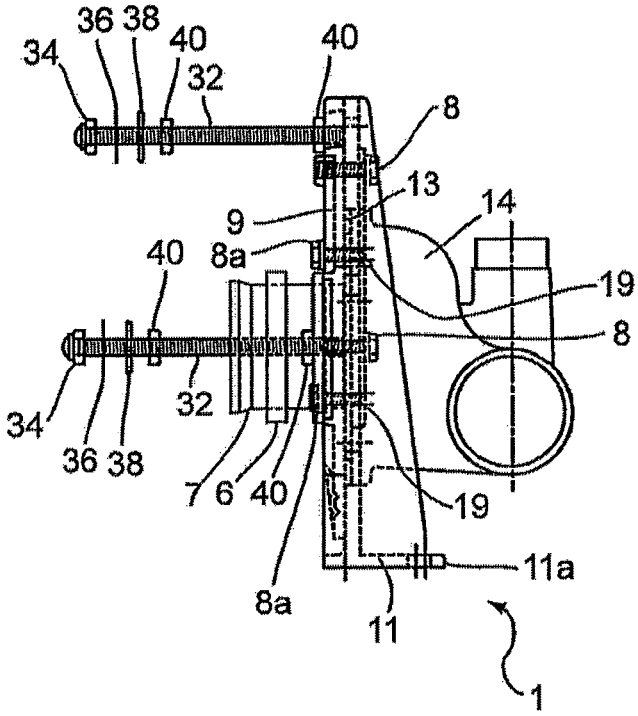
FIG. 4 is a side elevational view of the carrier of FIG. 2.
Figure 5:
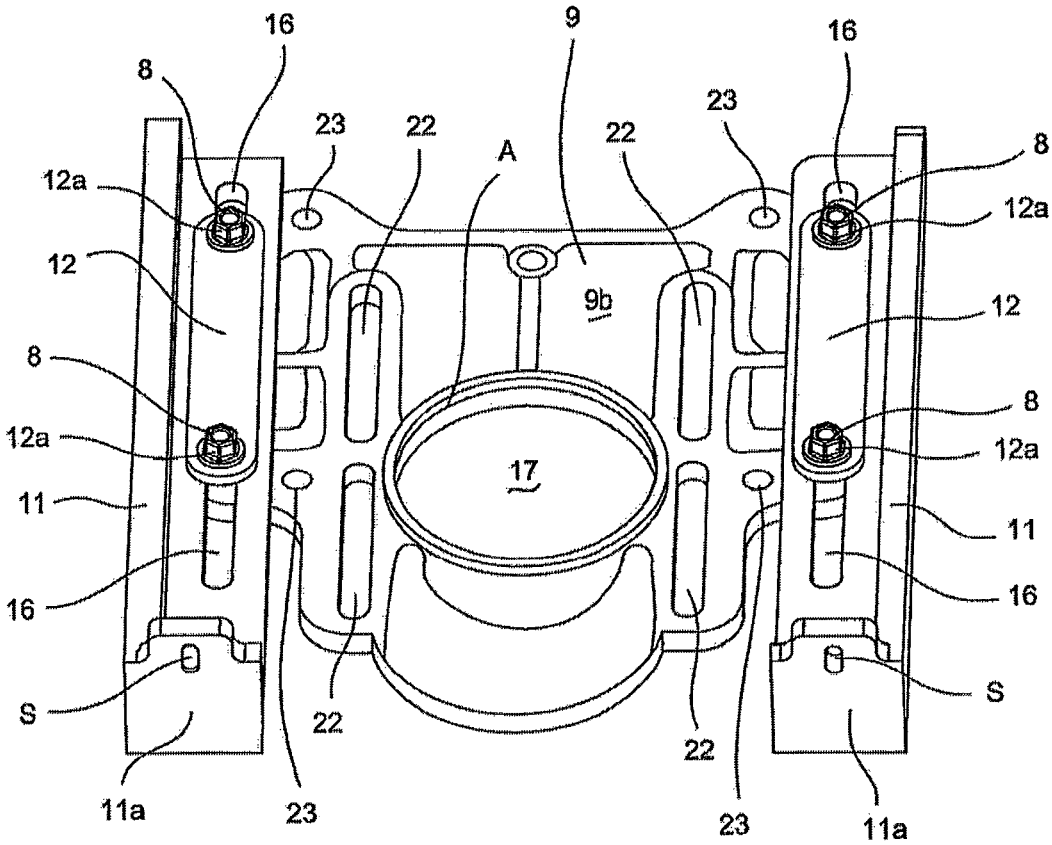
FIG. 5 is a top perspective view showing the faceplate, pedestals and mounting plates of the carrier of FIG. 1 assembled together with a first side or surface 9*b* of the faceplate facing outwardly in the drawing.
Figure 6:
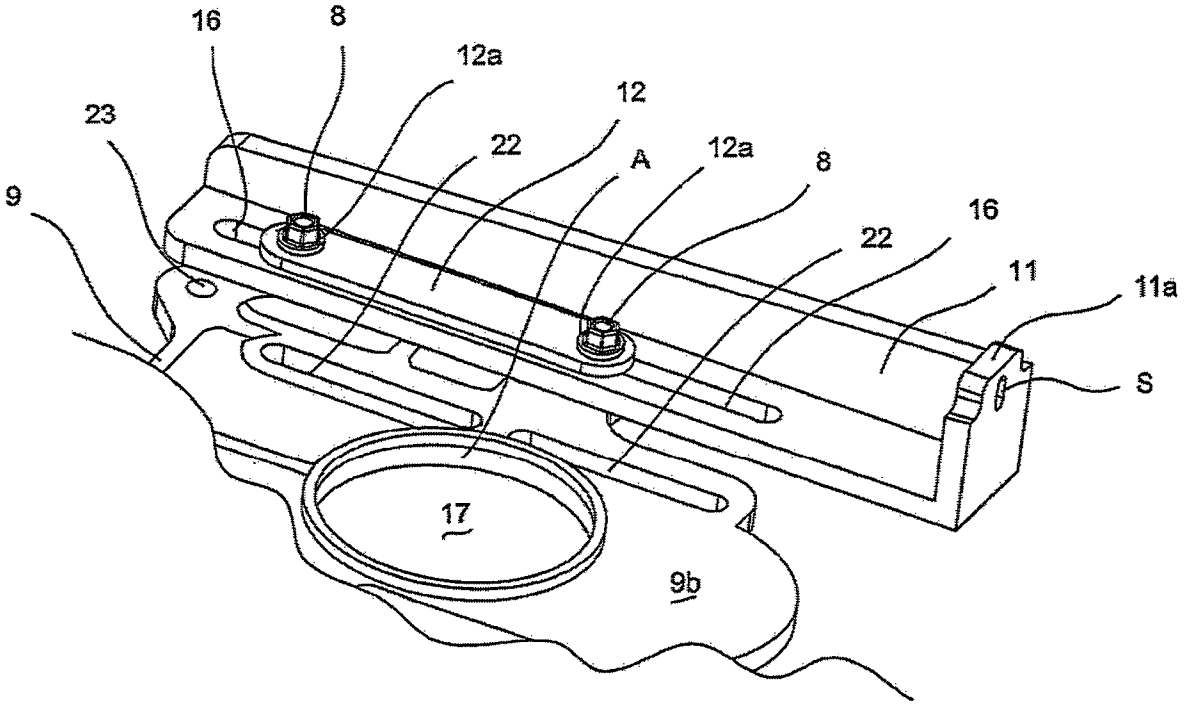
FIG. 6 is a partial, top perspective view showing the faceplate, a pedestal and a mounting plate of the carrier of FIG. 5.
Figure 7:
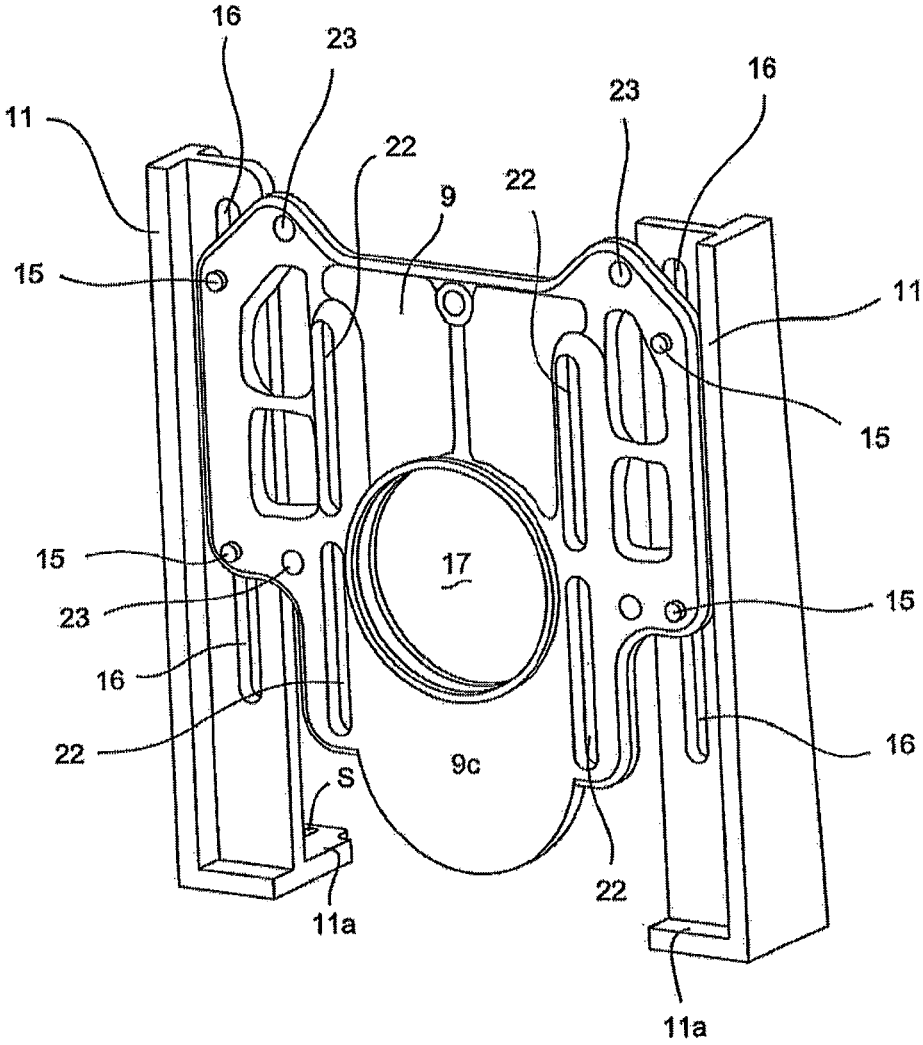
FIG. 7 is a perspective elevational view showing the faceplate, pedestals and mounting plates of the carrier of FIG. 1 assembled together with a second side or surface 9*c* of the faceplate 9 facing outwardly in the drawing.

With regard to the first support assembly 1 of FIGS. 1-9, as shown best in FIGS. 5 and 6, faceplate 9 has a first side 9*b*, and as shown best in FIG. 7, faceplate 9 has second opposite side 9*c*. A hole or opening 17 extends through faceplate 9 between its first side 9*b* and its second side 9*c*. As best shown in FIGS. 5 and 6, on the first side 9*b* of faceplate, hole 17 includes a recessed annular slot A as shown best in FIG. 1, an O-ring 10 is received in recessed annular slot A. The first side 9*b* has a relatively flat surface and the second side 9*c* of face plate 9 has a relatively ribbed surface.

As particularly shown in FIG. 7, faceplate 9 has a plurality of threaded holes 15 and a plurality of vertical slots 22. As particularly shown in FIG. 3, pedestals 11 have two vertical slots 16. As shown in FIGS. 1, 5 and 6, each mounting plate 12 is elongated and has two holes 12*a*, one located at its opposed ends.

As best shown in FIGS. 5 and 6, each mounting plate 12 is mounted to a surface of one of the pedestals 11 opposite the surface which abuts the first side 9*b* of faceplate 9. Mounting plates 12, also referred to as washer plates 12, replace the conventional washers of the prior art.

As best shown in FIGS. 3 and 5, pedestals 11 each have two elongated vertical slots 16 and pedestals 11 are right-handed and left-handed. That is, the pedestal 11 located to the left is a left-handed pedestal and is configured to be mounted to the left of faceplate 9. The pedestal 11 located to the right is a right-handed pedestal and is configured to be mounted to the right of faceplate 9 and against the first side 9*b* of face plate 9. Outer surfaces of the pedestals 11 are shown to be vertical, although they can also be tapered or any other shape.

Referring again to FIG. 5, the right-handed and left-handed pedestals 11 are connected along the two opposed ends of and against the first side 9*b* of faceplate 9 by way of washer plates 12 and threaded hex screws 8.

Referring to FIGS. 1 and 7, threaded screws 8 extend through holes 12*a* of mounting plate 12, extend through the vertical slots 16 of pedestals 11 and mate with corresponding threaded holes 15 (FIG. 7) formed in faceplate 9. The two dotted lines A travel to the left in FIG. 1 and illustrate the fastening of washer plates 12 and pedestals 11 to faceplate 9.

As shown best in FIG. 5, four threaded hex screws 8 are provided. This arrangement of threaded hex screws 8 extending through holes 12*a* of washer plates 12, through vertical slots 16 of pedestals 11 and anchored in threaded holes 15 of faceplate 9, allows the vertical height of faceplate 9 to be adjusted relative to pedestals 11 or the vertical height of pedestals 11 to be adjusted relative to faceplate 9 for proper positioning of faceplate 9 and/or pedestals 11 relative to floor F (FIG. 1) and the other components of the support system of the invention, more about which will be discussed herein below. The range for this adjustment of the vertical height of faceplate 9 and/or the vertical height of pedestals 11 will correspond to the length of vertical slots 16 in pedestals 11. As discussed hereinabove, each pedestal 11 has a foot 11*a* with a slot S for receiving a ½ inch bolt for securing the pedestal 11 to the floor surface F. The washer plates 12 distribute the loads on the pedestals 11 therefore resulting in less parts for the first support assembly 1 compared to the support assemblies of the prior art. The configuration of the pedestals 11 allows vertical movement between the pedestals 11 and the faceplate 9; whereas the configuration of the faceplate 9 allows vertical movement between the fitting member 14 and the faceplate 9.

Figure 8:
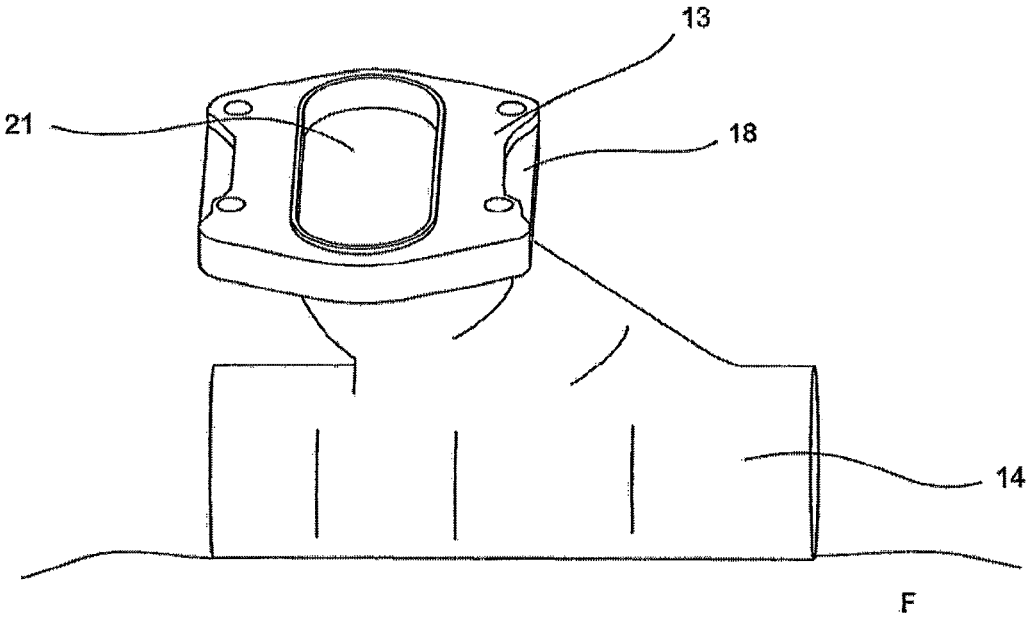
FIG. 8 is a perspective elevational view of a fitting member of the carrier of FIG. 1 in its disassembled form and resting on a floor surface F.
Figure 9:
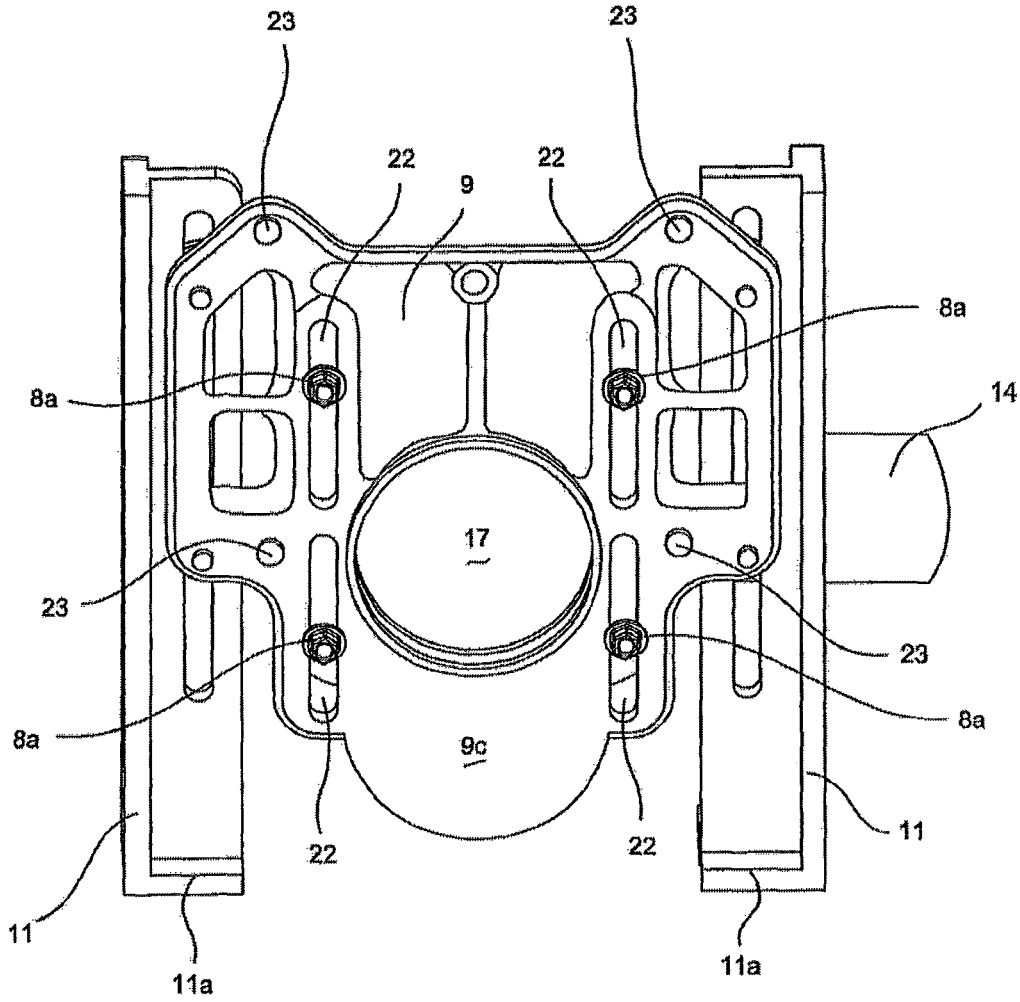
FIG. 9 is a rear elevational view showing the faceplate and pedestals and the manner in which the elongated studs fit within the slots of the faceplate of the carrier of FIG. 1.

Referring particularly to FIGS. 1 and 8 and the first support assembly 1 of the invention, and with particular reference to the right of FIG. 1, fitting member 14 has a surface 18. Surface 18 of fitting member 14 is relatively flat and is configured to be mounted against the first side 9*b* of faceplate 9. As shown best in FIGS. 2-4, when fitting member 14 is mounted to faceplate 9, fitting member 14 is located centrally relative to faceplate 9 while each pedestal 11 is connected to the faceplate along its ends.

Figure 2:
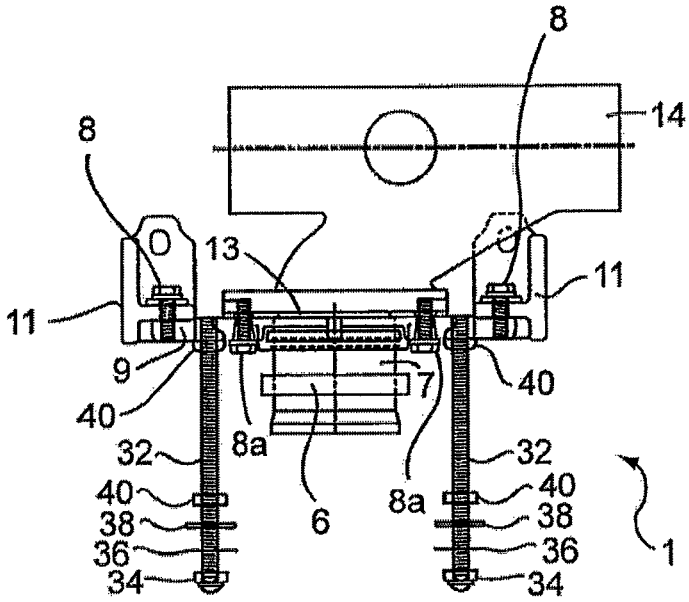
FIG. 2 is a top plan view of the carrier shown in FIG. 1 in assembled form.
Figure 4A:
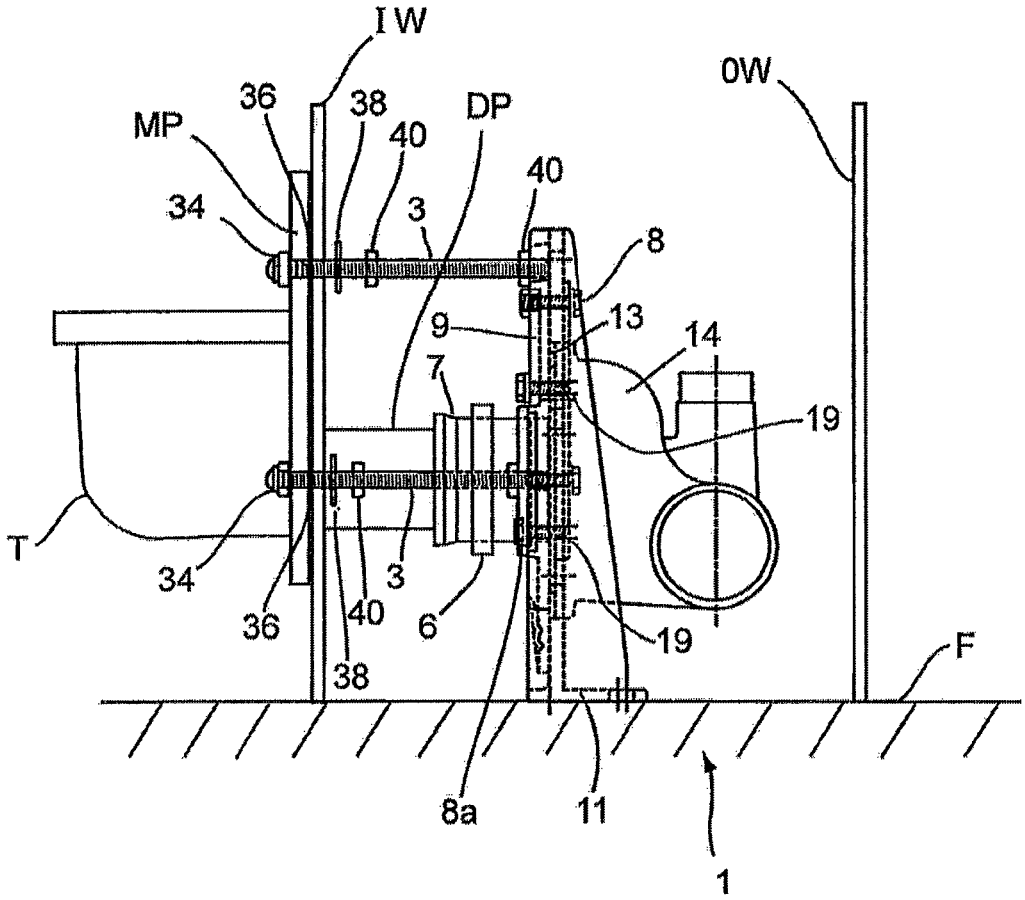
FIG. 4*a* is a side elevational view showing a toilet attached to the first support assembly of FIG. 4.

In order to obtain a water-tight fit between fitting member 14, faceplate 9 and cylindrical coupling 7, the gasket 13 (FIGS. 1, 2 and 4) is positioned between the first side 9*b* of faceplate 9 and surface 18 of fitting member 14. As shown in FIG. 1, gasket 13 has a plurality of holes 13*a* that are aligned with several threaded holes 19 located in surface 18 of fitting member 14. As shown in FIG. 8, surface 18 of fitting member 14 has an oval-shaped inlet indicated at 21. When this oval shaped inlet 21 of fitting member 14 is properly aligned with hole 17 in faceplate 9, the holes 13*a* of gasket 13 and the threaded holes 19 of fitting member 14 are aligned with slots 22 in faceplate 9 (FIGS. 1, 2 and 4).

Referring again particularly to FIG. 1, threaded hex screws 8*a* located to the left of faceplate 9 in FIG. 1 extend through slots 22 in faceplate 9, through holes 13*a* of gasket 13 and are threaded into threaded holes 19 of faceplate 9 in order to secure fitting member 14 against the first side 9*b* of faceplate 9. Two dotted lines B travel to the right of FIG. 1 and illustrate this fastening of faceplate 9 to fitting member 14. This arrangement of threaded hex screws 8*a* extending through slots 22 in faceplate 9, through holes 13*a* of gasket 13 and then coupled to threaded holes 19 of fitting member 14 allows adjustment of the vertical position of fitting member 14 relative to faceplate 9 and/or the adjustment of the vertical position of faceplate 9 relative to fitting member 14 so that the support system of the invention can be properly located relative to the floor surface F and the other components of the support system. As shown best in FIG. 9, four threaded hex screws 8*a* are provided. In order to facilitate fluid communication between inlet 21 of fitting member 14 and hole 17 of faceplate 9, inlet 21 and, hence, gasket 13 have an oval shape to permit vertical alignment of fitting member 14 with respect to hole 17.

Still referring particularly to FIG. 1, the support assembly 1 further includes a cylindrical coupling 7. This coupling 7 located to the left of faceplate 9 in FIG. 1 is configured to be positioned within hole 17 of faceplate 9 and is supported in hole 17 by a frictional fit between the exterior surface of coupling 7 and O-ring 10. Coupling 7 has a threaded outer surface, and hole 17 has a threaded inner surface. Coupling 7 is threaded into corresponding threads in the threaded inner surface of hole 17. When coupling 7 is positioned in hole 17 in faceplate 9, it extends away from the second side 9*c* of faceplate 9. A gasket 6, known in the art as a closet gasket, is disposed on or adjacent the end of coupling 7 opposite faceplate 9 to facilitate a fluid-tight connection with discharge port DP of a water closet or toilet T (FIG. 4*a*).

Still referring to the support assembly 1 and with particular reference to FIGS. 1 and 3, there are also provided a plurality of threaded elongated studs 32. Threaded studs 32 extend horizontally relative to support assembly 1 and are threaded into threaded holes 23 which are located in the second side 9*c* of faceplate 9. These studs 32 are anchored such that each threaded stud 32 extends away from the second side of faceplate 9, and as shown in FIGS. 3, 4 and 4*a*, four threaded studs 32 are provided. As shown in FIG. 1, each stud 32 includes a cap nut 34, a fiber washer 36, a washer 38 and two jamb nuts 40 mounted along the length of stud 32 to facilitate the positioning of the first support assembly 1 relative to the inner wall IW of the structure (FIG. 4*a*), and therefore, mounting of a water closet or toilet T to the first support assembly 1 of the invention.

The support assembly 1 is structured such that it can accommodate a 300 pound load rating without exceeding the deflection requirements as outlined in ASME Standard A112.6.1M, entitled "Floor-Affixed Supports for Off-The Wall Plumbing Fixtures for Public Use". The support assembly 1 provides for a compact construction in that the overall depth of the support system or the water closet carrier of the invention from the back of fitting member 14 to the front of faceplate 9 measures less than about 9.5 inches, making this a relatively narrow water closet carrier for its positioning between the inner wall IW and outer wall OW of a structure.

FIGS. 10-13 illustrate a second support assembly 2 and a third support assembly 3 connected to the first support assembly 1 of the support system of the invention. This arrangement of FIGS. 10-13 is generally referred to as a bariatric carrier. In this arrangement, the first support assembly 1 has the same components as particularly disclosed with respect to FIGS. 1-9, and therefore these components of the first support assembly 1 have the same numerals.

Second support assembly 2 relates to the fitting member 14 of the first support assembly 1 of FIGS. 1-9. With particular reference to FIGS. 10-13, this second support assembly 2 includes a support 30 which is located opposite to the surface 18 of fitting member 14. Support 30 generally will be an integral member of fitting member 14 and has a slot 31 (FIGS. 10 and 13) configured to co-act with a threaded stud 25. A threaded anchor foot 24 is coupled to one end of stud 25 and is anchored via fastening means, e.g., bolt (not shown), to floor F of the structure in which the support system of the invention is installed.

Support 30, anchor foot 24 and stud 25 provide support to fitting member 14 opposite surface 18 so that some of the weight of the user can be evenly distributed through the support system for supporting toilet T. Thus, this arrangement of support 30, anchor foot 24 and stud 25 avoids the need for the first support assembly 1, i.e., pedestals 11 and faceplate 9, to support the entire weight of a user of the toilet. As is apparent, anchor foot 24 can be adjusted vertically within support 30 via threaded stud 25 to provide sufficient support of the second support assembly 2 against a floor surface. This vertical adjustment of the second support assembly 2 can also be made to coincide with the vertical adjustments made to faceplate 9 and coupling 7 relative to the spaced-apart pedestals 11 for overall support of first support assembly 1 and the second support assembly 2 against the floor surface.

Figure 10:
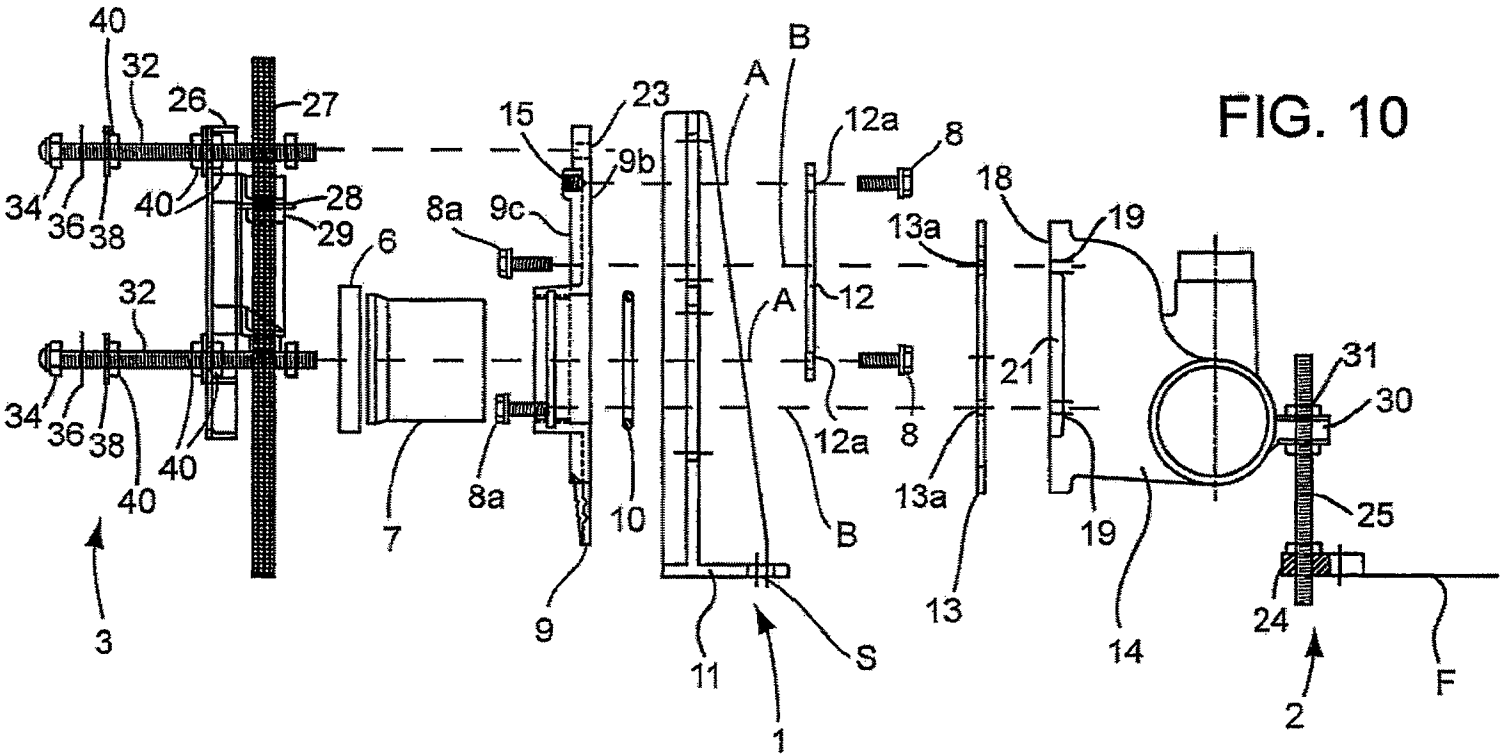
FIG. 10 is an exploded side elevational view of a bariatric carrier or support system illustrating a second support assembly and a third support assembly in addition to the first support assembly of FIGS. 1-9 in accordance with the teachings of the present invention.
Figure 11:
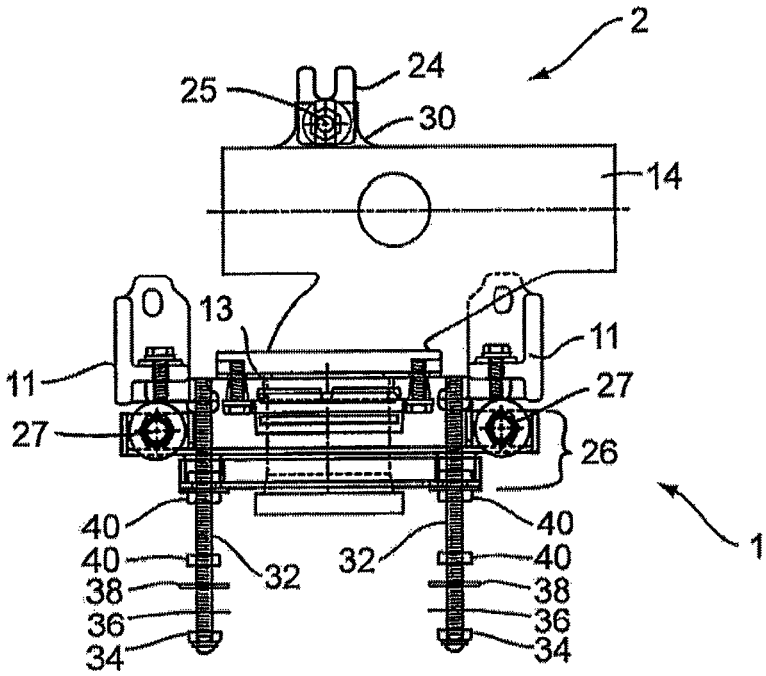
FIG. 11 is a top plan view of the carrier shown in FIG. 10 in assembled form.
Figure 12:
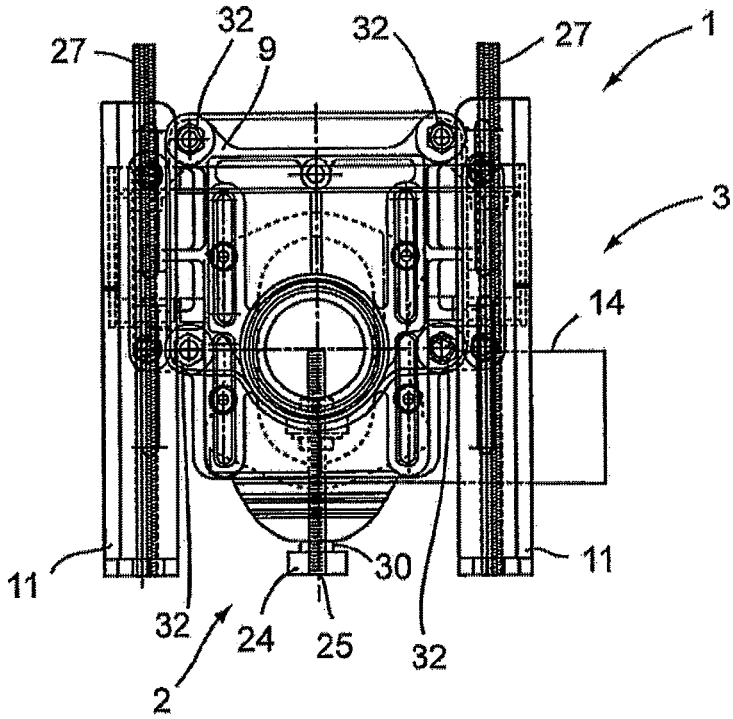
FIG. 12 is a front elevational view of the carrier shown in FIG. 11.
Figure 13:
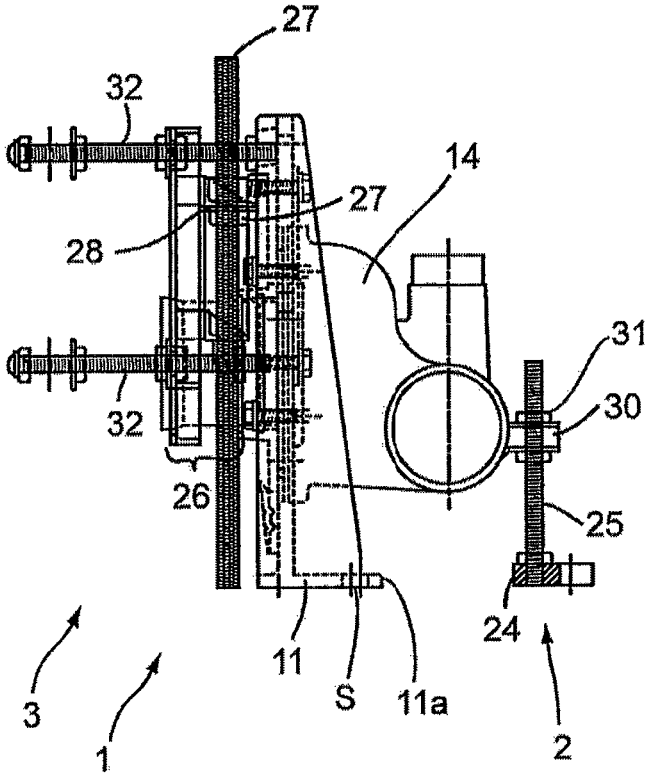
FIG. 13 is a side elevational view of the carrier shown in FIG. 11.

A third support assembly 3 is shown to the left of FIG. 10. As shown in FIGS. 11, 12 and 13, third support assembly 3 is located on a side of support assembly 1 opposite to the location of the second support assembly 2. As particularly shown in FIGS. 10, 11 and 13-16, the third support assembly 3 includes a generally rectangular frame 26 having an opening for receiving the coupling 7. Frame 26 is mounted to and supported by threaded studs 32 that extend through suitably oriented holes in frame 26. In addition to four horizontal threaded studs 32, this third support assembly 3 includes a pair of vertical threaded studs 27 mounted to frame 26 on opposite sides of coupling 7 via vertically disposed holes in frame 26 (shown best in FIGS. 14 and 16). Each stud 27 is secured against upward movement by way of a nut 29 (FIG. 15) disposed on stud 27 beneath one of the vertically disposed holes in frame 26.

Figure 14:
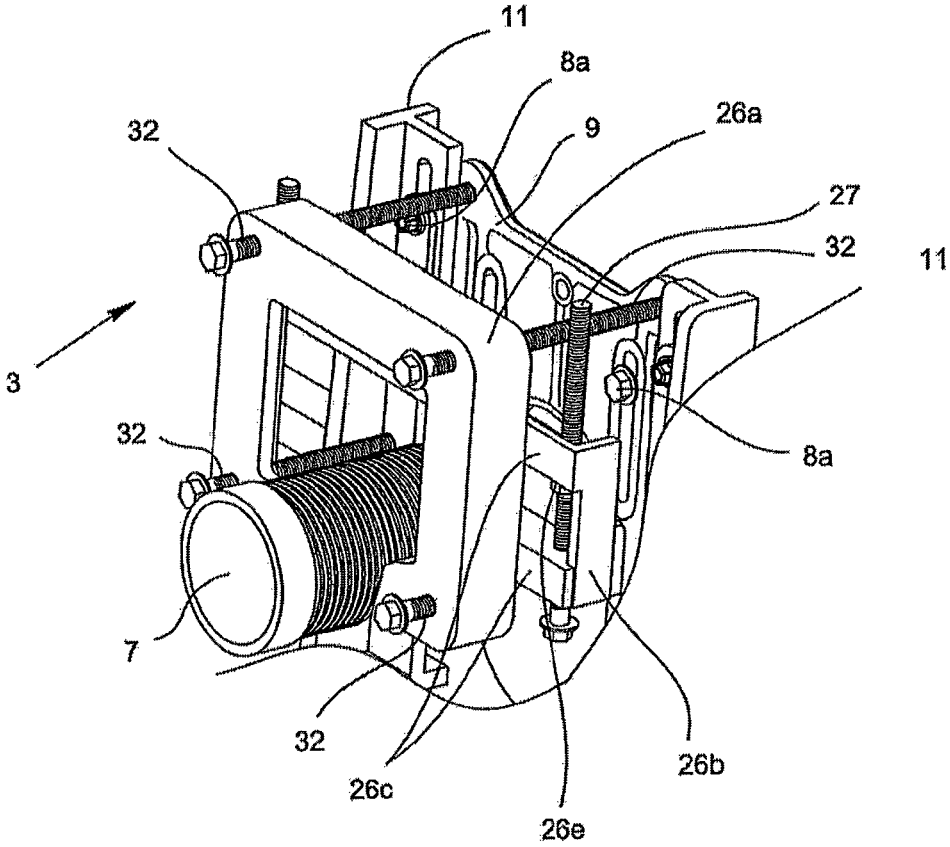
FIG. 14 is a front perspective partial view illustrating more clearly the third support assembly of FIG. 11.
Figure 15:
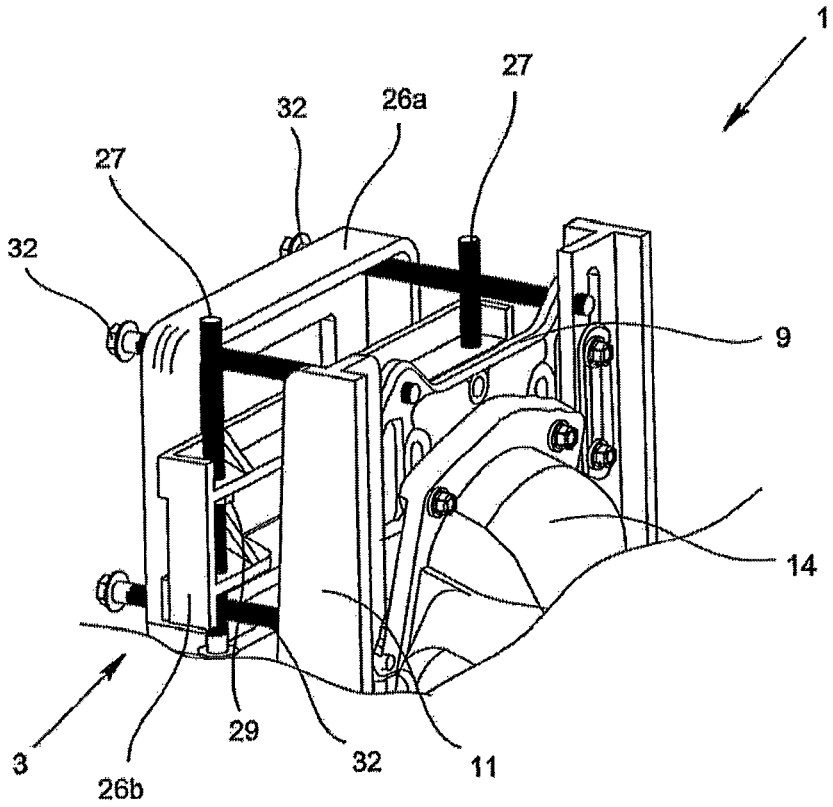
FIG. 15 is a rear perspective partial view illustrating more clearly the third support assembly of FIG. 11.
Figure 16:
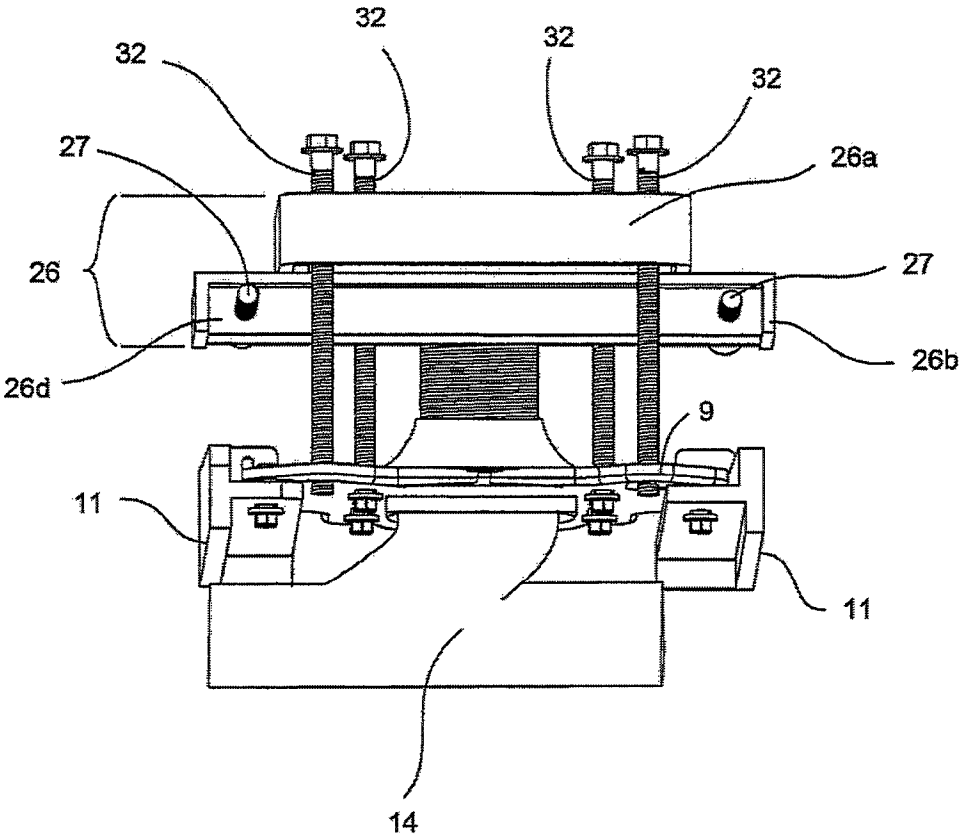
FIG. 16 is a top plan view illustrating more clearly the third support assembly of FIG. 11.

As best shown in FIGS. 14-16, frame 26 has a main section 26*a* and a winged section 26*b* which has horizontally extending portions 26*c* or members with threaded holes for receiving vertical threaded studs 27, which act as vertical supports directly attached to the frame 26. This third support assembly 3 allows a mounted toilet or water closet to adequately support more weight compared to a toilet or water closet which is supported only by the first support assembly 1 or which is supported by the first support assembly 1 and the second support assembly 2. The frame 26 distributes the weight on the support assembly via the threaded studs 32. Also, the vertical threaded studs 27 allow the third support assembly to be adjusted and moved vertically to coincide with the vertical positions of the first support assembly 1 and the second support assembly 2 relative to the floor of the structure in which the toilet T is mounted.

The support system of the invention, which includes the first support assembly 1 and the second support assembly 2, is structured such that it can meet a 750 pound load rating without exceeding the deflection requirements as outlined in ASME Standard A112.6.1M, entitled "Floor-Affixed Supports for Off-The Wall Plumbing Fixtures for Public Use".

The support system of FIGS. 10-16 which includes the first support assembly 1, the second support assembly 2 and the third support assembly 3, is referred to as an XB bariatric carrier". This support system is structured such that it can meet a 1000 pound load rating without exceeding the deflection requirements as outlined in ASME Standard A112.6.1M, entitled "Floor-Affixed Supports for Off-The Wall Plumbing Fixtures for Public Use".

The several components described above for the support assemblies 1, 2, and 3 may be made through a cast iron or cast steel process except for gasket 13, O-ring 10 and fiber washer 36. Gaskets 6 and 13 and O-ring 10 may be made of an elastomer material, e.g., neoprene or rubber and fiber washer 36 may be made of fiberglass. Some of the components may also be attached to each other by welding or by threaded corrections, in a manner obvious to one skilled in the art.

A toilet attached to a wall of a structure includes the first support assembly 1, the second support assembly 2 and the third support assembly 3, as described hereinabove, depending on the weight of the user.

The present invention also provides one or more methods for attaching the toilet to the wall of the structure, including installing the first support assembly 1 and, optionally, support assemblies 2 and 3 described hereinabove between the outer wall OW and an inner wall IW of the structure (FIG. 4*a*).

Referring particularly to FIGS. 1-9, a first method for attaching a toilet to a wall of a structure includes installing the first support system 1 between the outer wall IW and the inner wall IW of the structure; extending the first threaded stud arrangement 32, 34, 36, 38 and 40 through the mounting plate MP of the toilet T, through the inner wall IW of the structure and into the faceplate 9; prior to tightening the first fastener 8 and the second fastener 8*a*, adjusting the pedestals 11 and the faceplate 9 relative to each other so that the coupling 7 in the hole 17 of the faceplate 9 is aligned with the inlet 21 of the fitting member 14 and so that the pedestals 11 are supported on the floor F of the structure; attaching a discharge port DP of the toilet T to the coupling in the faceplate 9 for its connection to the fitting member 14 of the first support assembly 1; and tightening the first fastener 8 and the second fastener 8*a*.

Referring to all the figures, a further method for attaching a toilet T to a wall W of a structure includes the steps of installing the first support assembly 1 between an outer wall OW and an inner wall IW of the structure; attaching the second support assembly 2 to the first support assembly 1 between the outer wall OW and the inner wall IW of the structure; extending the first threaded stud arrangement 32, 34, 36, 38 and 40 of the first support assembly 1 through the mounting plate MP of the toilet T, through the inner wall IW of the structure and into the faceplate 9 of the first assembly 1; prior to tightening the first fastener 8 and the second fastener 8*a* of the first support assembly 1, adjusting the pedestals 11 and the faceplate 9 of the first support assembly 1 relative to each other so that the coupling 7 in the hole 17 of the faceplate 9 is aligned with the inlet 21 of the fitting member 14 of the first support assembly 1 and the pedestals 11 are supported on the floor F of the structure; attaching the discharge port DP of the toilet T to the coupling 7 in the faceplate 9 for its connection to in the inlet 21 of the fitting member 21 of the first support assembly 1; and adjusting the anchor foot 24 of the second support assembly 2 vertically so that the second support assembly 2 is supported on the floor F of the structure.

A still further method for attaching a toilet T to a wall of a structure includes the steps of installing the first support assembly 1 and the second support assembly 2 between an inner wall IW and an outer wall OW of a structure; attaching the third support assembly 3 of to the first support assembly 1; extending the first threaded stud arrangement 32, 34, 36, 38, and 40 of the first support assembly 1 through the mounting plate MP of the toilet T, through the inner wall IW of the structure and into the faceplate 9 of the first support assembly 1; prior to tightening the first fastener 8 and the second fastener 8*a* of the first support assembly 1, adjusting the pedestals 11 and the faceplate 9 of the first support assembly 1 relative to each other so that the hole 17 of the faceplate 9 is aligned with the inlet 21 of the fitting member 14 of the first support assembly 1 and the pedestals 11 are supported on the floor F of the structure; adjusting the anchor foot 24 of the second support assembly 2 vertically so that the second support assembly 2 is supported on the floor F of the structure; and adjusting the third threaded stud arrangement 3 vertically so the frame 26 of the third support assembly 3 is in alignment with the hole 17 of the faceplate 9 and the third threaded stud arrangement 27 of the third support assembly 3 is supported on the floor F of the structure; extending the coupling 7 into the frame 26 of the third support assembly 3, through the hole 17 of the faceplate 9, and into the inlet 21 of the fitting member 14 of the first support assembly 1; and attaching the discharge port DP of the toilet T to the coupling 7.

The two latter methods include vertically adjusting the anchor foot 24 of the second assembly 2 so that the floor level of the second support assembly 2 is the same as that of the pedestals 11 of the first support assembly 1. Also, the vertical studs 27 of the third support assembly 3 can be vertically adjusted so that the floor level of these studs 27 is the same as that of anchor foot 24 and pedestals 11.

The present invention has been described with reference to the preferred embodiments. Obvious modifications and alterations will occur to others upon reading and understanding the preceding detailed description. It is intended that the invention be construed as including all such modifications and alterations.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A support assembly for supporting a wall mounted toilet structure, comprising:

a frame having an opening for receiving a coupling;

a first arrangement mounted directly to the frame on either side of the coupling for supporting the frame on a floor of the structure and configured to vertically adjust the frame relative to the floor of the structure;

a second arrangement mounted directly to the frame for mounting the toilet to the frame and positioning the frame relative to the wall of the structure and for connecting the frame to further support assemblies disposed on an opposite side of the frame from the wall and the toilet, wherein the first arrangement is mounted to the frame such that the frame is vertically adjustable with respect to the first arrangement, wherein the frame includes a portion having at least one vertically disposed hole defined therein and the first arrangement directly engages the vertically disposed hole, wherein the first arrangement is a threaded stud arrangement comprising vertical threaded studs, wherein the vertical threaded studs are secured against upward movement by a respective nut, wherein the frame further includes a main section and a winged section, the winged section including the portion having at least one vertically disposed hole defined therein such that the first arrangement directly engages the winged section, wherein the winged section includes the portion having at least one vertically disposed hole defined therein, which comprises horizontally extending portions each having at least one vertically disposed hole defined therein, and vertically extending portions connecting the horizontally extending portions to each other, and wherein the vertically disposed holes defined in the respective horizontally extending portions are aligned and the first arrangement directly engages each of the vertically disposed holes.

2. The support assembly according to claim 1, wherein the second arrangement directly engages the main section of the frame.

3. A support system for mounting a toilet to a wall of a structure, comprising a first support assembly, a second support assembly connected to the first support assembly, and a third support assembly connected to the first support assembly, wherein the first support assembly comprises:

a fitting member having a body defining a passageway;

a gasket attached to the fitting member and positioned upstream of the fitting member;

a faceplate having a first side and a second side, and a hole extending through the faceplate, the faceplate being attached to the fitting member and positioned upstream of the fitting member with the gasket being positioned between the first side of the faceplate and the fitting member;

a first pedestal attached to the faceplate, the first pedestal being vertically adjustable relative to the faceplate;

a coupling passing through the hole of the faceplate, and in fluid communication with the fitting member passageway; and a first arrangement extending from the second side of the faceplate for positioning the first support assembly relative to the wall of the structure and for mounting the toilet, wherein the second support assembly comprises:

a support member attached to the body of the fitting member, the support member having a slot;

a second arrangement in engagement with the slot of the support member, the second arrangement configured to be vertically adjustable relative to the support member and the body of the fitting member; and an anchor member in engagement with the second arrangement for supporting the fitting member on a floor of the structure, and wherein the third support assembly comprises:

a frame having a passage through which the coupling passes upstream of the first support assembly, wherein the frame is attached to the faceplate by the first arrangement; and at least one vertical support directly attached to the frame for supporting the frame on the floor of the structure and configured to adjust the frame relative to the first support assembly and the floor of the structure, wherein the at least one vertical support is configured to directly engage the floor of the structure.

4. The support system according to claim 3, wherein the faceplate is attached to the fitting member such that the faceplate is vertically adjustable with respect to the fitting member.

5. The support system according to claim 3, wherein the first support assembly further comprises a second pedestal attached to the faceplate, the second pedestal being vertically adjustable relative to the faceplate.

6. The support system according to claim 3, further comprising a washer attached to the first pedestal.

7. The support system according to claim 6, further comprising a first fastener connecting the washer, the first pedestal, and the faceplate.

8. The support system according to claim 3, further comprising a second fastener connecting the faceplate and the fitting member.

9. The support system according to claim 3, wherein the second arrangement comprises a threaded stud.

10. A carrier for a wall mounted toilet comprising:

a fitting member having a body defining a passageway and an inlet;

a faceplate having a first side and a second side, and a hole extending through the faceplate, the faceplate being attached to the fitting member in a position upstream of the fitting member;

a gasket positioned between the first side of the faceplate and the fitting member;

a first pedestal attached to the faceplate, the first pedestal being vertically adjustable relative to the faceplate;

a coupling passing through the hole of the faceplate, and in fluid communication with the fitting member passageway;

a first arrangement extending from the second side of the faceplate for positioning the faceplate relative to a wall;

a frame having a passage through which the coupling passes upstream of the faceplate, the frame being attached to the faceplate by the first arrangement; and at least one vertical support directly attached to the frame for supporting the frame on a floor of the structure and configured to adjust the frame relative to the faceplate and the floor of the structure, wherein the at least one vertical support is configured to directly engage the floor of the structure.

11. The carrier according to claim 10, further comprising:

a support member attached to the body of the fitting member, the support member having a slot;

a second arrangement in engagement with the slot of the support member, the second arrangement configured to be vertically adjustable relative to the support member and the body of the fitting member; and an anchor member in engagement with the second arrangement for supporting the fitting member on the floor of the structure.

12. The carrier according to claim 11, wherein the second arrangement comprises a threaded stud.

13. The carrier according to claim 10, wherein the faceplate is attached to the fitting member such that the faceplate is vertically adjustable with respect to the fitting member.

14. The carrier according to claim 10, further comprising a second pedestal attached to the faceplate, the second pedestal being vertically adjustable relative to the faceplate.

15. The carrier according to claim 10, further comprising a washer attached to the first pedestal.

16. The carrier according to claim 15, further comprising a first fastener connecting the washer, the first pedestal, and the faceplate.

17. The carrier according to claim 10, further comprising a second fastener connecting the faceplate and the fitting member.

18. A carrier for a wall mounted toilet comprising:

a fitting member having a body defining a passageway and an inlet;

a first support assembly having a first side and a second side, and a hole extending through the first support assembly, the first support assembly being attached to the fitting member in a position upstream of the fitting member, the first support assembly being vertically adjustable with respect to a floor of the structure;

a coupling passing through the hole of the first support assembly, and in fluid communication with the fitting member passageway;

a first arrangement extending from the second side of the first support assembly for positioning the first support assembly relative to a wall;

a horizontally extending member attached to the first support assembly by the first arrangement at a position along the coupling upstream of the first support assembly, the horizontally extending member including a portion having at least one vertically disposed hole defined therein; and at least one vertical threaded stud directly engaging the at least one vertically disposed hole in the portion of the horizontally extending member for supporting the horizontally extending member on the floor of the structure and adjusting the horizontally extending member relative to the first support assembly and the floor of the structure, wherein the at least one vertical threaded stud is secured against upward movement by a nut, and wherein the at least one vertical threaded stud is configured to directly engage the floor of the structure.

19. A carrier for a wall mounted toilet comprising:

a fitting member having a body defining a passageway and an inlet;

a faceplate having a first side and a second side, and a hole extending through the faceplate, the faceplate being attached to the fitting member in a position upstream of the fitting member;

a gasket positioned between the first side of the faceplate and the fitting member;

a first pedestal attached to the faceplate, the first pedestal being vertically adjustable relative to the faceplate;

a coupling passing through the hole of the faceplate, and in fluid communication with the fitting member passageway;

a first arrangement extending from the second side of the faceplate for positioning the faceplate relative to a wall;

a horizontally extending member past which the coupling passes upstream of the faceplate, the horizontally extending member being attached to the faceplate by the first arrangement; and at least one vertical support directly attached to the horizontally extending member for supporting the horizontally extending member on a floor of the structure and configured to adjust the horizontally extending member relative to the faceplate and the floor of the structure, wherein the at least one vertical support is attached to the horizontally extending member such that the horizontally extending member is vertically adjustable with respect to the at least one vertical support, wherein the at least one vertical support is configured to directly engage the floor of the structure.

20. A carrier for a wall mounted toilet comprising:

a fitting member having a body defining a passageway and an inlet;

a first support assembly having a first side and a second side, and a hole extending through the first support assembly, the first support assembly being attached to the fitting member in a position upstream of the fitting member, the first support assembly being vertically adjustable with respect to a floor of the structure;

a coupling passing through the hole of the first support assembly, and in fluid communication with the fitting member passageway;

a first arrangement extending from the second side of the first support assembly for positioning the first support assembly relative to a wall;

a horizontally extending member past which the coupling passes upstream of the first support assembly, the horizontally extending member being attached to the first support assembly by the first arrangement; and at least one vertical support directly attached to the horizontally extending member for supporting the horizontally extending member on a floor of the structure and configured to adjust the horizontally extending member relative to the first support assembly and the floor of the structure, wherein the at least one vertical support is attached to the horizontally extending member such that the horizontally extending member is vertically adjustable with respect to the at least one vertical support, wherein the at least one vertical support is configured to directly engage the floor of the structure.

* * * * *